United States Patent [19]

Hansson

[11] Patent Number: 4,534,066

[45] Date of Patent: Aug. 13, 1985

[54] GLOVE

[76] Inventor: Erik Hansson, Box 137, S-811 23 Sandviken, Sweden

[21] Appl. No.: 657,358

[22] Filed: Oct. 2, 1984

[30] Foreign Application Priority Data

Oct. 7, 1983 [SE] Sweden ..... 8305526

[51] Int. Cl.[3] ..... A41D 19/00

[52] U.S. Cl. ..... 2/163; 2/158; 2/159; 2/169

[58] Field of Search ..... 2/158, 159, 160, 161 R, 2/161 A, 163, 165, 166, 169, 162, 167, 168, 20, 2/16, 17, 18, 19, 164

[56] References Cited

U.S. PATENT DOCUMENTS

| | | | |
|---|---|---|---|
| 1,072,560 | 9/1913 | Baskin | 2/159 |
| 2,343,449 | 3/1944 | Franzl | 2/169 |
| 2,380,633 | 7/1945 | Daiber | 2/158 |
| 2,760,203 | 8/1956 | DeGrazia | 2/158 |

FOREIGN PATENT DOCUMENTS

| | | | |
|---|---|---|---|
| 478730 | 11/1951 | Canada | 2/161 R |

*Primary Examiner*—Louis K. Rimrodt
*Assistant Examiner*—Joseph S. Machuga
*Attorney, Agent, or Firm*—Zarley, McKee, Thomte, Voorhees & Sease

[57] ABSTRACT

A glove comprises a palm portion (2) with a first finger section (5) intended for the index and a second finger section (6) intended for the middle finger, the ring finger and the little finger. The index section (5) is formed of a material piece, which before the assemblage of the glove was separate from the palm portion for the rest and has portions in one piece therewith projecting upwardly along the sides of the index. The second finger section (6) has portions formed in one piece therewith projecting upwardly along the side of the middle finger exposed to the index. The index section is hanging together in one piece with a material section (9) which at the palm side projects so as to cover that region (4), where the thickened bone sections at the joint between the base phalanx bone of the index and the corresponding metacarpus bone are intended to be located. (FIG. 2).

6 Claims, 8 Drawing Figures

GLOVE

FIELD OF THE INVENTION AND DESCRIPTION OF THE PRIOR ART

This invention is related to a glove, the palm portion of which comprises a first finger section intended for the index and a second finger section intended for the middle finger and preferable also for the ring- and little fingers.

In a known glove of this type the palm portion is, with the exception of one or more pieces forming the thumb, formed out of one single material piece. The finger sections are by seams fixed to separate wedge-shaped pieces, which are located along the sides of the finger sections facing towards each other. These wedge-shaped pieces are thereafter in the upper region of the sides of the index and the middle finger sewn on to the back portion of the glove. Thus, the result is a glove in which seams will be located between the middle finger and the index on both finger sections. Such seams make the mobility of the glove inferior and therefore it becomes more difficult for the user of the glove to carry out accurate working operations. Also, a glove with such seams between the finger sections become rather imperfect concerning the working life, because the seams cause a hard wear. Known before is the building up of the palm portion by several material pieces in order to get the possibility to place seams in the finger region to the back side of the glove. Seams which connect these material pieces in the region of the metacarpus section of the palm portion then, however, tend to be placed so that they cause insufficient convenience for the wearer.

SUMMARY OF THE INVENTION

The object of the present invention is to reduce disadvantages in known gloves and to attain a glove with high comfort and good fit. This object is achieved by giving the glove the characteristics defined in the appendent claims.

The design of the index section as a separate material piece makes it possible that this section can be designed to project upwardly along the sides of the index; consequently one can displace the seams between the index section and the back portion of the glove in the direction towards the back side of the hand. Further, it is easy to design the second finger section so that pieces thereof project upwardly along the side of the middle finger exposed to the index, so that also there the seam can be displaced relative to the back portion in the direction towards the back side of the hand. Thus, the index sides and the side of the middle finger exposed to the index become mainly free from seams, which drastically improves the mobility and the sensitivity of a hand clothed by the glove. In order to attain a good gripping ability, primarily as far as the index is concerned, it is essential to design the material piece forming the index section so that this piece is hanging together in one piece with a material section which at the palm side projects so as to cover at least the portion, which is located closest to the base phalanx of the index, of the region where the thickened bone sections at the joint between the base phalanx bone of the index and the corresponding bone of metacarpus are intended to be located. When gripping for instance a round object with use of the index and the thumb, the object will lie against the thickened joint region between the base phalanx bone of the index and the corresponding bone of metacarpus. Through said design of the index section it is guaranteed that no seams are required in this region between the index section and the other material pieces. Thus, a good sensitivity with respect to grip will be attained. The seams between the index section and the other portions of the palm portion can consequently be placed beside said index joint so that through making use of at least two material pieces for the palm portion, attaining of absence of seams in at least the lower portion of the index sides and of the side of the middle finger exposed to the index, is made possible. A joint between the index section and the second finger section extends from a point at the root of the interspace between the index section and the second finger section obliquely, with respect to the longitudinal direction of the hand, inwardly towards and preferable as far as to a middle region or a middle point of the metacarpus section of the palm portion. Thereby is attained that said joint will be placed well beside the thickened joint region between the base phalanx of the index and the corresponding bone of metacarpus, which is advantageous for the grip-function because frequently grip occurs between the thumb and said thickened joint region.

BRIEF DESCRIPTION OF THE DRAWINGS

With reference to the appended drawings there follows below a more specific description of embodiments of the invention quoted as examples. In the drawings.

DESCRIPTION OF THE PREFERRED EMBODIMENT

Figure 1:
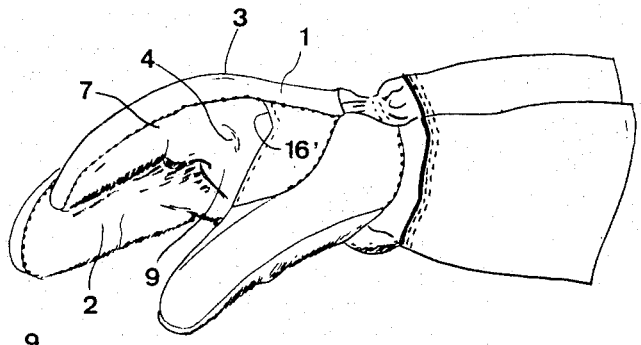
FIG. 1 is a perspective view of a glove substantially from its thumb side.
Figure 2:
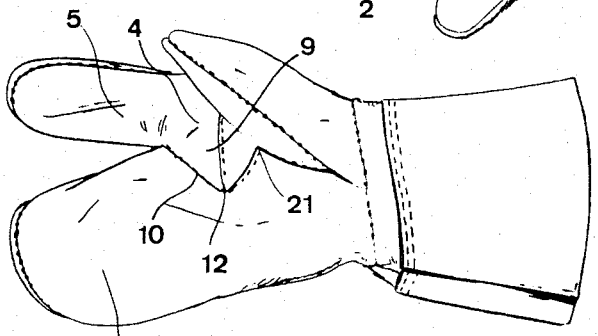
FIG. 2 is a view of the palm side of the glove.

In FIGS. 1 and 2 a glove with a back portion 1 and a palm portion 2 is illustrated. The back portion is usually prolonged in relation to the palm portion of the glove, so that the glove on one hand will be adapted to the form of a hand in a resting position and on the other permit easy closing of the hand without too strong wrinkling of the palm portion. That region of the back side of the glove where the thickened bone sections (the knuckle) at the joint between the base phalanx bone of metacarpus are intended to be located, is in FIG. 1 indicated by 3. The corresponding region of the palm side of the glove is in FIGS. 1 and 2 indicated by 4.

The embodiment according to FIGS. 1–4 will now first be described. The palm portion of the glove comprises a finger section 5 intended for the index and a second finger section 6 intended to receive not only the middle finger but also the ring- and little fingers.

The index section 5 is formed of a material piece which before the assemblage of the glove was separate from the palm portion for the rest. The index section 5 has portions formed in one piece therewith which project sufficiently upwardly along the sides of the index to replace the wedge-shaped pieces of the known gloves mentioned above. The second finger section 6 has pieces formed in one piece therewith which project upwardly along the side of the middle finger exposed to the index and also along the outside of the little finger and the metacarpus portion of the glove.

The material piece which forms the index section 5 is hanging together in one piece with a material section 9 which at the palm side projects so as to cover that region 4, where the thickened bone sections at the joint between the base phalanx bone of the index and the corresponding metacarpus bone are intended to be located. Although the projecting material section 9 only would have to cover the portion of the thickened joint region located closest to the outer end of the index, since on grip with aid of the index primarily this portion comes into supporting contact with the object concerned, it is preferred that the section 9 covers mainly the whole thickened joint region. Through this it will be possible, as will be explained in more detail in the following, to place seams between the index section and the palm portion for the rest beside the thickened joint region.

A first joint 10 in the form of a seam between the index section 5 and the finger section 6 extends from a first point 11 (FIG. 4) at the root of the interspace between the finger sections 5, 6 in the direction towards a second point 12, located mainly in the middle region of metacarpus. This seam 10 is attained by sewing the edges 13 of the finger sections 5 and 6 and the edges 14 of said sections together to the state according to FIG. 4.

The index section is fixed to a further piece 15 by a second joint seam 16 along which the edge 17 of the finger section is sewn on butt or with a constant overlapping at the straight edges 18 and 19 of the piece 15. Because the edge 18 is disposed at an angle to the edge 19, the seam 16 will be at an angle at the glove side (see 16' in FIG. 1) and the seam will form such a local curvature which in detail is described in the U.S. Pat. No. 4,494,249 of the applicant. The piece 15 extends as far as to and partly up along the thumb while overlapping the inner thumb angle. The piece 15 is fixed to a middle section of the metacarpus portion through a third joint seam 20 extending from the point 12 in the direction towards the place where the joint between the base phalanx of the thumb and the corresponding metacarpus bone is intended to be located. Said seam 20 more exactly connects the edges 21 of the piece 15 and of the finger section 6 which consequently is formed of a single piece projecting so as to cover also the place where the metacarpus of the user is intended to be located.

In the embodiment example the point 12 will be located in the deepest region of the metacarpus, which is advantageous. The seam 10 will extend in the softer region between the joints between the base phalanxes of the index and of the middle finger and the corresponding metacarpus bones. Further the seam 16 will be disposed in the soft metacarpus region between the metacarpus bone which corresponds to the thumb and the joint between the base phalanx of the index and the corresponding metacarpus bone.

In the assemblage of the glove the palm portion is put together in the way described, and one or several pieces forming the thumb section are sewn on to the corresponding recess 22 of the palm portion and the back portion 1. Furthermore a cuff may be added.

Figure 3:
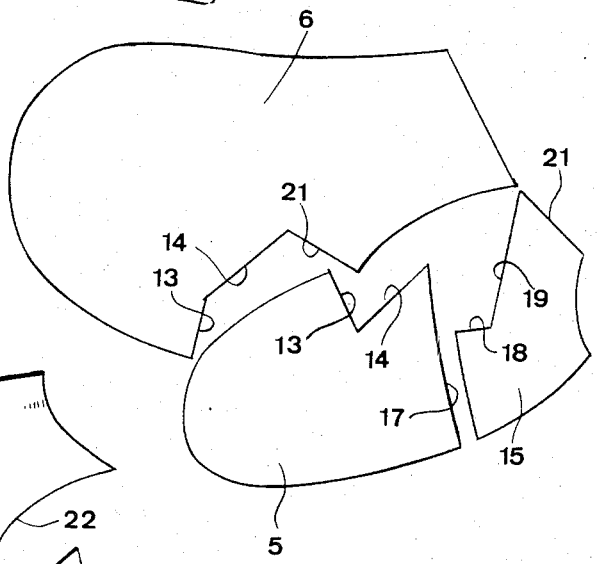
FIG. 3 is a view of material pieces participating in the forming of the palm portion of the glove.
Figure 4:
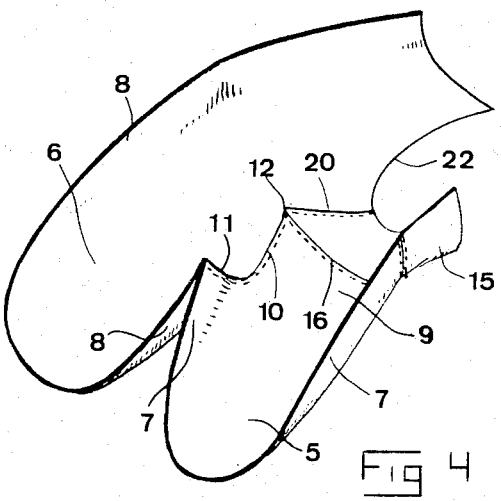
FIG. 4 is a perspective view illustrating the material pieces according to FIG. 3 assembled in the position they take in a ready-made glove.
Figure 5:
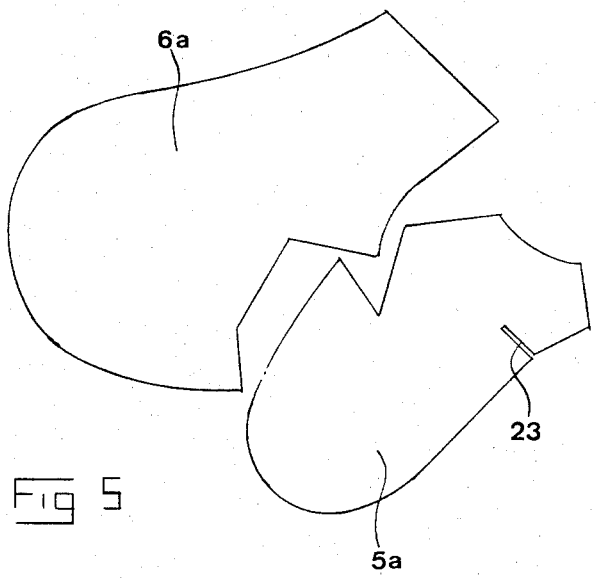
FIGS. 5 and 6 are views, corresponding to FIGS. 3 and 4, of an embodiment variant.
Figure 6:
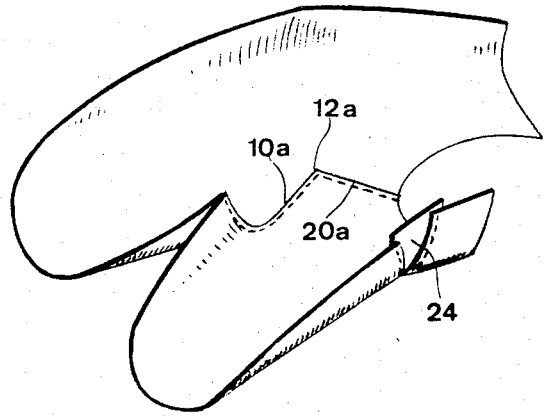

The embodiment illustrated in FIGS. 5 and 6 corresponds to the one described above with the exception that the index section **5*a* has in one piece a material section corresponding to the piece 15 in FIG. 3. Instead of producing, as in the embodiment according to FIGS. 1–4, a local curvature of the glove in the region of the knuckle joints with aid of the angled edge 18 a slit 23 is used in FIGS. 5 and 6, which in the assembled state of the glove is expanded (and eventually closed by a piece 24) while forming the said local curvature. In the embodiment according to FIGS. 5 and 6 one can therefore spare the seam 16**.

Figure 7:
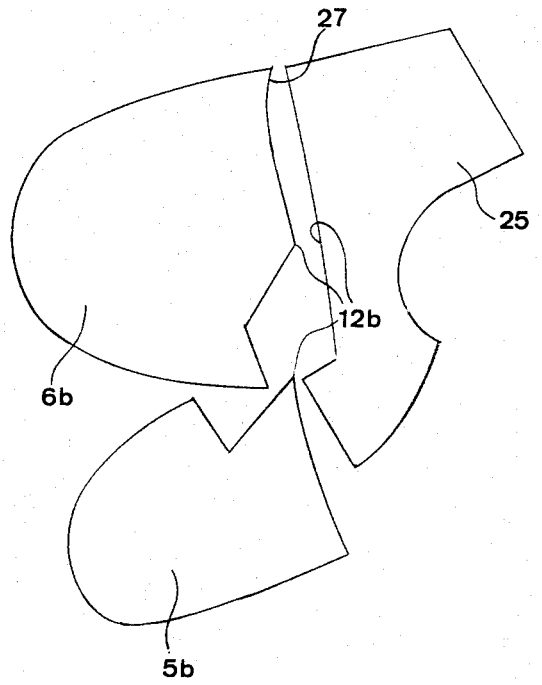
FIGS. 7 and 8 are views, similar to FIGS. 3 and 4, of another embodiment variant.
Figure 8:
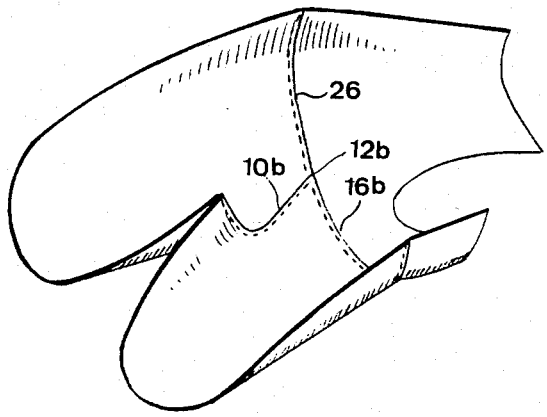

The embodiment according to FIGS. 7 and 8 differs primarly from the embodiment according to FIGS. 1–4 in that a special metacarpus piece 25 is arranged, which extends straight across the metacarpus. The finger section **5*b* is as before fixed to the finger section 6*b* through the seam 10*b*. Further, the finger section 5*b* is through the seam 16*b* fixed to the metacarpus section 25. At the point 12*b* the seam 16 is connected to a further joint seam 26 extending mainly in the prolongation of the seam 16*b*. Thus, the seam 26 makes a connection between the finger section 6*b* and the metacarpus section 25. The spots, which in FIG. 8 are joined in the point 12*b* are also in FIG. 7 indicated with the corresponding notation. The finger section 6*b* has at its little finger side a projection 27, which in the sewing together butt on butt with constant overlapping to the metacarpus portion 25** causes a local curvature also at this side of the glove.

Of course the invention can be modified in a plurality of ways within the scope of the invention idea. For example the glove could be provided with separate finger sections for each of the middle-, ring- and little fingers. It is possible to apply a strengthening piece on the outside of the palm portion, which piece covers certain or all of the discussed seams 10, 16, 20 and 26.

What is claimed is:

1. A glove, the palm portion of which comprises a first finger section intended for the index and a second finger section intended for the middle finger and preferable also for the ring- and little fingers, which index section is formed of a material piece which before the assemblage of the glove was separate from the rest of the palm portion and has portions formed in one piece therewith and projecting upwardly along the sides of the index, the second finger section having portions formed in one piece therewith and projecting upwardly along the side of the middle finger exposed to the index, the material piece forming the index section hanging together in one piece with a material section, which on the palm side projects so as to cover at least that portion, which is closest to the base phalanx of the index, of the region where the thickened bone sections at the joint between the base phalanx bone of the index and the corresponding bone of the metacarpus are intended to be located, the second finger section having portions formed in one piece therewith, which project beyond the place intended for the metacarpus on the palm side of the glove and which at this place are fixed to said material section included in the index section, by a joint extending from a first point at the root of the interspace between the index section and the second finger section to a second point located mainly in the middle region of the metacarpus so that the joint between said first and second points extends, with respect to the longitudinal direction of the hand, obliquely inwards towards the middle region of the metacarpus.

2. A glove according to claim 1, in which said projecting material section covers mainly the whole thickened joint region between the base phalanx bone of the index and corresponding metacarpus bone.

3. A glove according to claim 1, in which the index section is fixed to an additional piece by a second joint seam extending mainly transversely to the longitudinal direction of the hand.

4. A glove according to claim 3, in which said additional piece extends to the region of the glove intended for the thumb and is fixed to a middle section of the metacarpus portion by a third joint extending from said second point in the direction towards the place, where the joint between the base phalanx and the metacarpus bone of the thumb is intended to be located.

5. A glove according to claim 1, in which the index section extends to the vicinity of the thumb and is fixed to a middle section of the metacarpus portion by a third joint seam extending from said second point in the direction towards the place where the joint between the base phalanx and the metacarpus bone of the thumb is intended to be located.

6. A glove according to claim 3, in which said second joint seam extends mainly in the prolongation of a fourth joint seam between said additional piece and the second finger section.

* * * * *